US009688083B2

(12) United States Patent
Campanini

(10) Patent No.: US 9,688,083 B2
(45) Date of Patent: Jun. 27, 2017

(54) PRINTER FOR KIOSKS

(71) Applicant: CUSTOM S.P.A., Fontevivo (Parma) (IT)

(72) Inventor: Alberto Campanini, Fidenza (IT)

(73) Assignee: CUSTOM S.P.A., Fontevivo (Parma) (IT)

( * ) Notice: Subject to any disclaimer, the term of this patent is extended or adjusted under 35 U.S.C. 154(b) by 0 days.

(21) Appl. No.: 14/762,322

(22) PCT Filed: Nov. 29, 2013

(86) PCT No.: PCT/IB2013/060492
§ 371 (c)(1),
(2) Date: Jul. 21, 2015

(87) PCT Pub. No.: WO2014/115000
PCT Pub. Date: Jul. 31, 2014

(65) Prior Publication Data

US 2015/0367653 A1 Dec. 24, 2015

(30) Foreign Application Priority Data

Jan. 28, 2013 (IT) ..... MO2013A0019

(51) Int. Cl.
*B41J 13/00* (2006.01)
*B41J 11/00* (2006.01)
(Continued)

(52) U.S. Cl.
CPC ..... *B41J 11/007* (2013.01); *B41J 11/70* (2013.01); *B41J 13/106* (2013.01); *B41J 15/04* (2013.01);
(Continued)

(58) Field of Classification Search
CPC ..... B41J 11/007; B41J 11/39; B41J 13/00; B41J 13/0036; B41J 13/009; B41J 13/106; B65H 29/52
(Continued)

(56) References Cited

U.S. PATENT DOCUMENTS 5,179,504 A * 1/1993 Kitahara ..... G06K 13/08 235/475
7,185,347 B2 * 2/2007 Hino ..... G11B 17/0404 720/647
(Continued)

FOREIGN PATENT DOCUMENTS

EP 2529938 A2 12/2012
JP H0916818 A 1/1997
(Continued)

OTHER PUBLICATIONS

International Search Report and Written Opinion of the International Searching Authority Application No. PCT/IB2013/060492 Completed: Mar. 12, 2014; Mailing Date: Mar. 21, 2014 8 pages.

*Primary Examiner* — Geoffrey Mruk
*Assistant Examiner* — Scott A Richmond
(74) *Attorney, Agent, or Firm* — Whitmyer IP Group LLC

(57) ABSTRACT

A printer for kiosks is disclosed that includes an anti-intrusion door that is movable between a normal closed position and an open position in which it respectively closes and opens a passage through which a printed document is guided, moving from the normal closed position to the open position by a thrust exerted by the exiting document and returning to the closed position through the effect of its weight after the printed document has been removed.

20 Claims, 2 Drawing Sheets

(51) Int. Cl.

| | |
|---|---|
| ***B41J 11/70*** | (2006.01) |
| ***B41J 13/10*** | (2006.01) |
| ***B41J 15/04*** | (2006.01) |
| ***B65H 35/04*** | (2006.01) |

(52) U.S. Cl.
CPC ..... *B65H 35/04* (2013.01); *B65H 2407/11* (2013.01); *B65H 2407/50* (2013.01); *B65H 2408/13* (2013.01); *B65H 2701/1936* (2013.01)

(58) Field of Classification Search
USPC ..... 347/104
See application file for complete search history.

(56) References Cited

U.S. PATENT DOCUMENTS

| | | | | |
|---|---|---|---|---|
| 2001/0014245 | A1* | 8/2001 | Seres | B41J 11/62 400/693 |
| 2006/0182483 | A1 | 8/2006 | Paucker et al. | |
| 2011/0024966 | A1* | 2/2011 | Fujii | B41J 13/106 271/3.14 |
| 2011/0293347 | A1* | 12/2011 | Sekino | B41J 13/0009 400/582 |

FOREIGN PATENT DOCUMENTS

| | | | |
|---|---|---|---|
| WO | 0011615 | A1 | 3/2000 |
| WO | 2005090087 | A1 | 9/2005 |

* cited by examiner

PRINTER FOR KIOSKS

BACKGROUND OF THE INVENTION

The invention relates to a printer for kiosks, in particular for dispensing, through an outlet, tickets, receipts or printed slips.

Specifically, but not exclusively, the invention can be applied in a dispenser of tickets, receipts or printed slips located in a public place, for example for self-service kiosks (information, service or other types of kiosk), bank counters or instant tellers, parking meters or public transport payment terminals, access control systems, gaming machines, automatic dispensers in general, etc.

In particular the present invention refers to a printer for kiosks made in accordance with the preamble of the first claim.

Such a printer is known, for example from patent WO 2005/090087.

One of the drawbacks of the prior art is the risk of an undesired intrusion of objects inside the printer through the outlet of the printed document. This intrusion can be fraudulent or an act of vandalism but also accidental, for example because of a user of the kiosk who, through lack of attention, inserts an object (for example a banknote, a card or a form) into the wrong opening.

Another drawback is the risk of entry inside the printer of potentially harmful elements such as dust, rain, humidity, etc.

Another drawback is the risk that the thrust exerted by the document is not able to open the closure arrangement.

SUMMARY OF THE INVENTION

One object of the invention is to overcome one or more of the aforesaid drawbacks of the prior art.

One advantage is to make a printer for kiosks that is able to prevent an intrusion of objects through the outlet of the printed document.

One advantage is to make available a printer for kiosks that is able to dispense the printed document safely and reliably.

One advantage is to provide a printer for kiosks with a constructionally simple and cheap anti-intrusion system.

One advantage is to protect the inside of the printer from the entry of dust, rain, humidity or other undesired and potentially harmful elements.

Such objects and advantages, and still others, are achieved by the printer according to one or more of the claims set out below.

In one embodiment, the printer comprises a door that is movable between a normal closed position and an open position in which it respectively closes and opens a passage through which a document is guided (which is printed or to be printed), moving from the normal closed position to the open position through the effect of a thrust exerted by the document that advances and returning to the closed position through the effect of its weight after the document has been removed.

BRIEF DESCRIPTION OF THE DRAWINGS

The invention can be better understood and implemented with reference to the attached drawings that illustrate one embodiment thereof by way of non-limiting example.

DETAILED DESCRIPTION

Figure 1:
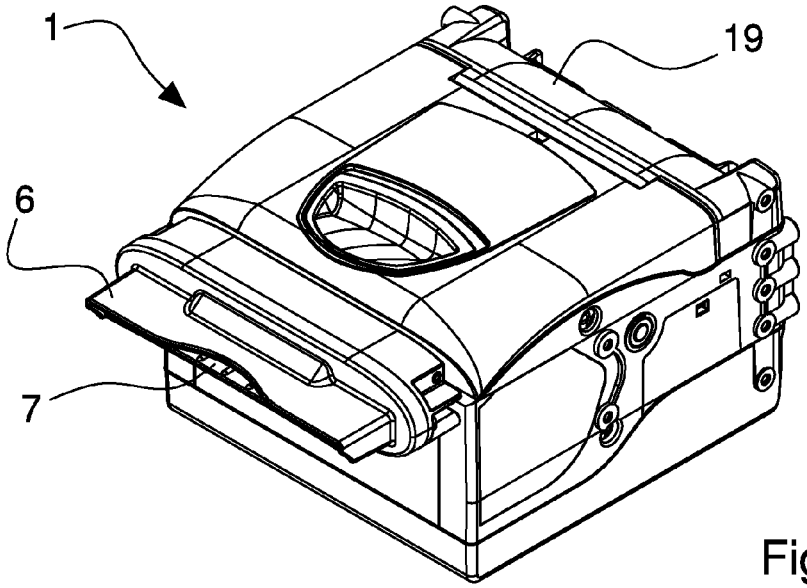
FIG. 1 is a perspective view of one embodiment of a printer for kiosks according to the invention.
Figure 2:
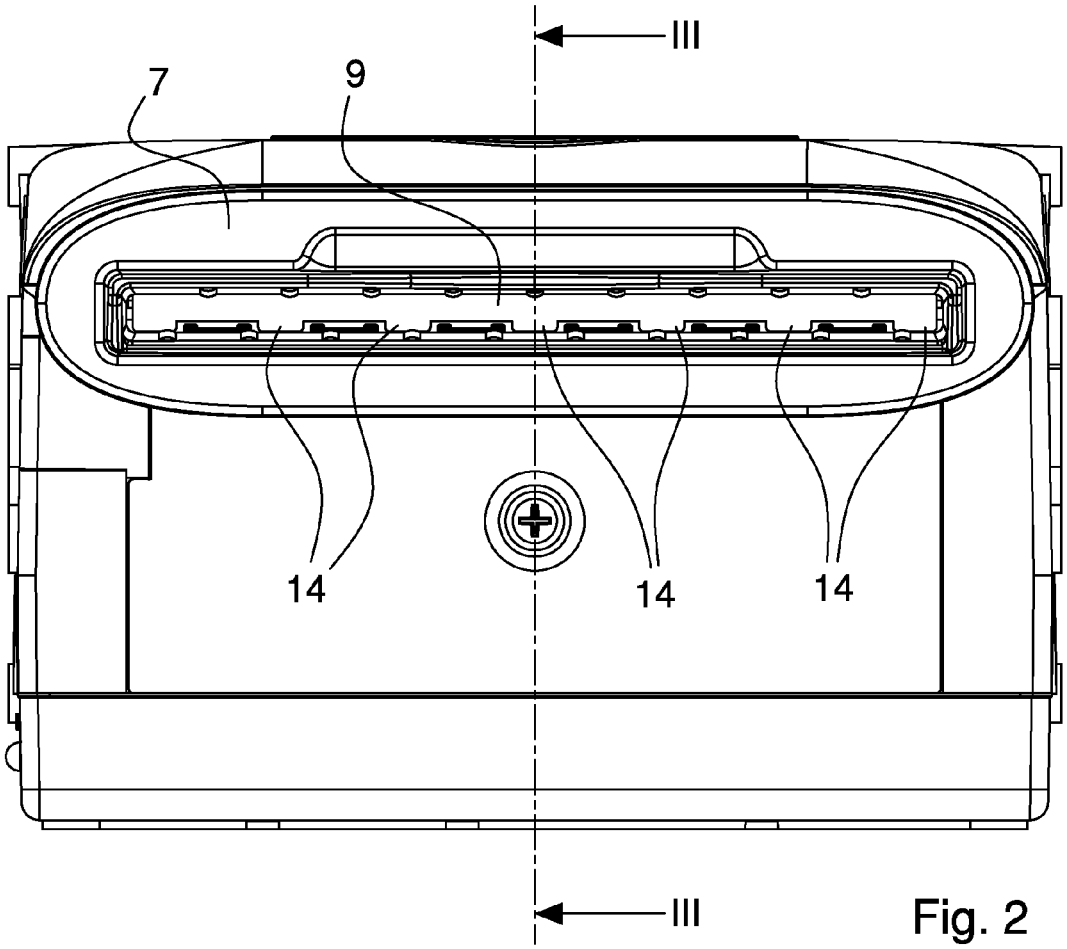
FIG. 2 is a vertical side view of the printer of FIG. 1.

With reference to the aforesaid figures, with 1 overall a printer for kiosks has been indicated that is for example usable in self-service kiosks, in bank counters or instant tellers, in parking meters, in access control systems, in gaming machines, in automatic dispensing machines in general.

The printer 1 comprises a printing arrangement for printing a document on a strip of material (for example paper) and for supplying the document downstream to an outlet zone 2. The printing arrangement may comprise, for example, a printing head 3 (in particular of known type). The printing head 3 may comprise, for example, a thermal printing head (as in this specific case) or a printing head of other type. The (thermal) printing head 3 comprises an advancement roller 4 that advances the strip of material to the outlet zone 2. It is possible to set up, as in this case, other advancement arrangement that collaborates with the (thermal) printing head 3. In the specific case, on the advancement path of the strip of material (for example downstream of the printing head 3) there is arranged a pair of print supporting material (paper) conveying rollers 5.

The printer 1 comprises at the outlet zone 2 of the printed document an outlet 6, for example in the form of an annular flange or protruding lip, through which the printed document is dispensed outside to be removed by a user. The outlet 6 has, in particular, an edge that surrounds (in particular all around) an outlet opening 7 of the document. The outlet 6 can have, in particular, an outlet opening 7 of narrow and elongated shape (for example arranged horizontally as in this case).

The printer 1 may comprise, as in the embodiment illustrated here, a separating arrangement, in particular arranged downstream of the printing head 3, to separate the printed document from the rest of the strip. Such a separating arrangement may comprise, for example, a movable blade or cutter 8 driven by a motor (controlled by a programmable electronic controller that may also control the other actuators of the printer 1). In other embodiments it is possible to provide a separating or cutting arrangement that comprise a stationary blade.

Figure 3:
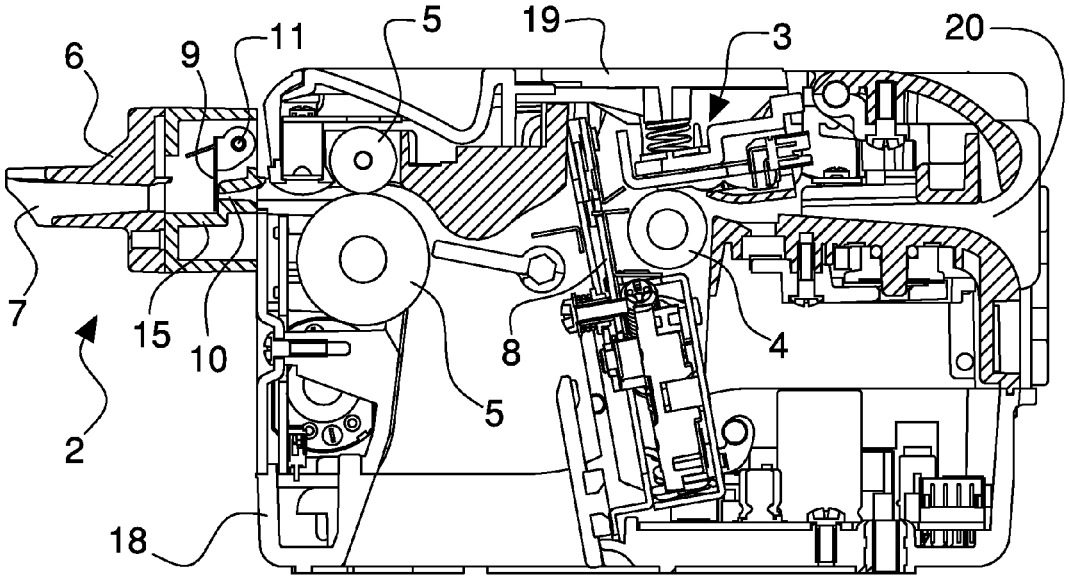
FIG. 3 is section III-III of FIG. 2.
Figure 4:
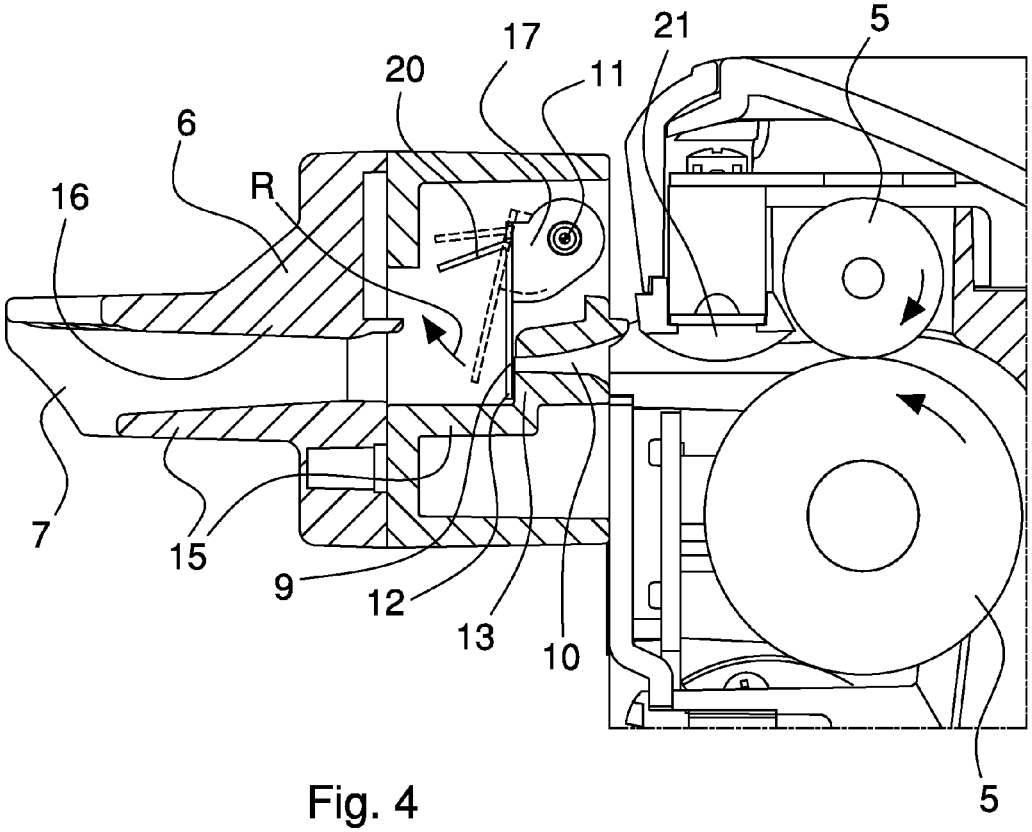
FIG. 4 shows an enlarged detail of FIG. 3.

The printer 1 comprises a shutting arrangement, or a door arrangement, arranged near the outlet zone 2. The shutting arrangement may comprise, for example, a door 9 (or hatch, shutter, or rolling door) that may be movable with the possibility of taking on a normal closed position (see FIG. 3 or 4) in which it closes a passage 10 arranged along the path of the document through which the document is guided and made to advance. As will be explained better below, the shutting arrangement is of monodirectional type, i.e. is shaped and arranged in such a manner as to obstruct the passage in one direction (to the inside of the printer) and to enable the passage in the opposite direction (outlet direction to the outside of the printer).

The passage 10 may be defined, as in this embodiment, by a guide portion, in particular in the form of an annular flange or protruding lip with a section converging forwards, arranged for guiding the advancement of the printing support.

The door 9 may further assume an open position (dashed in FIG. 4), for example a tilted position, in which it enables the printed document to exit via an opening arranged at an advanced end of the passage 10.

The door 9 may be shaped and arranged in such a manner as to be able to be moved to an open position through the effect of a thrust exerted by the printed document that exits through the passage 10 that is normally closed by the door.

In particular, the door 9 may be rotatable around a hinge axis 11 and have a free end 12 that is far from the hinge axis 11.

This free end 12 may be arranged on the advancement path of the exiting printed document or near this path.

The door 9 may be shaped and arranged in such a manner as to be openable around the hinge axis 11 with an opening rotation R (clockwise with reference to FIGS. 3 and 4) in which the free end 12 of the door is lifted and in such a manner as to be closable around the hinge axis 11 with a closing rotation (anticlockwise with reference to FIGS. 3 and 4) in which the free end 12 is lowered.

The printer 1 may comprise, in particular, an abutting arrangement 13 having at least one abutting surface against which the door 9 may close in an abutting manner such that this abutting surface achieves a closing (rotation) stroke. This abutting arrangement 13 may comprise, for example, at least one abutting surface on a wall located at the advanced end of the passage 10 obstructed by the door 9.

The tilting door 9 thus achieves one embodiment of the monodirectional shutting arrangement that is suitable for opening to enable the passage in the outlet direction from the inside of the printer to the outlet zone 2 (in particular leaving the passage free for the advancing print document) and remaining closed to prevent the passage in the opposite direction, i.e. from the outlet zone 2 to the inside of the printer. The tilting door 9 in fact enables the exit (through the passage 10) and does not permit the entrance, in particular because of abutting arrangement 13 that stops oscillation of the tilting door in one direction.

The free end 12 of the door may comprise at least one protrusion 14 arranged for abutting on the abutting arrangement 13. In the specific case two or more protrusions 14 are arranged (for example protrusions in the shape of a rectangular or trapezium tooth) that are alongside and spaced apart from one another, each of which can abut on the abutting arrangement 13.

The door 9 may be shaped and arranged in such a manner as to abut on the abutting arrangement 13, shutting the outlet passage 10 at or near the normal closed position.

The abutting surface may be arranged, as in the specific embodiment, at (the rise of) a step situated (immediately) downstream of the advanced end of the output passage 10 obstructed by the door 9 in the closed position.

The outlet 6 may comprise, as in this case, a guiding and protecting lower wall 15 that bounds below the advancement path of the printed document in the outlet zone 2 (in particular downstream of the passage 10 that is obstructed by the closed door 9). The (lower) free end 12 of the door 9 may be arranged above the lower wall 15 and may have a lower margin that, in the normal closed position of the door 9, is at least in part arranged very close or flush (without touching) the underlying lower wall 15.

The printer 1 may comprise a guiding and protecting upper wall 16 that bounds the advancement path of the printed document in the outlet zone 2 above. The upper wall 16 may be (as in this case) at least partially arranged above the lower wall 15. The lower and upper walls 15 and 16 may be extended (as in the embodiment illustrated here) beyond the door 9 ("beyond" must be understood with reference to the exit direction of the document). The outlet 6, in particular the lower and upper walls 15 and 16, protect at least in part the door 9 that is arranged at a certain distance from the outlet opening 7 that is the zone of actual interface with the user.

The door arrangement may be shaped and arranged so as to return to the normal closed position by the effect of its own weight, in particular after the printed document (that had caused the opening thereof) has been removed by the user or at least removed from the outlet zone 2.

The door 9 may comprise, as in this case, an occluding element of narrow and elongated shape, in particular of plate shape, which closes the (narrow and elongated) outlet passage 10 of the printed document. The occluding element may be hinged (around the hinge axis 11) near a long side thereof. In particular, the door 9 may comprise an occluding element made of light metal material, for example aluminium and/or light alloy.

The occluding element may be connected to the hinge axis 11 by an arm element 17 arranged in such a manner that the occluding element is arranged in a more advance manner (with reference to the outlet direction of the document) than the hinge axis 11. The arm element 17 is arranged, in particular, behind the occluding element and above the passage 10. The occluding element may be arranged vertically in a normal closed position (see FIGS. 3 and 4) and in a tilted position in the open position.

The arm element 17 may comprise, as in this case, two wings arranged on opposite sides of the occluding element and rotatably coupled with two respective pins (integral with the casing 19) on the hinge axis 11.

The occluding element may be provided with a balance cantilever 18 which, in particular, protrudes forward (with reference to the advancement of the strip of material or of the printed document). The cantilever 18 may be arranged, for example, on the opposite side to the arm element 17. The cantilever 18 promotes, owing to its weight and/or to its arrangement, correct and secure opening of the door arrangement by the printing material that pushes forwards and/or the correct and secure reclosing (by gravity) of the door arrangement (after the printing material that caused the opening has been removed). The cantilever 18 and the occluding element may be integrated together.

The printer 1 may comprise, in particular, a casing 19 (for example of box shape) to support and at least in part contain the various printer elements disclosed above. The casing 19 may have, in particular, an inlet 20 of the strip of material (paper), for example an inlet 20 arranged on a casing side opposite a casing side that bears the outlet zone 2 of the printed document.

The printer 1 may have sensors (of known type) connected to the controller, like, for example, a paper sensor 21 arranged upstream of the passage 10.

The strip of material may be supplied in a known manner, for example from a roll, from a continuous module ("fan-fold" type) or with other supply systems. The supply arrangement supplying the strip of material may comprise, for example, a magazine of material (for example a roll) arranged outside the casing 19 and connectable to the latter (in particular to the inlet 20) in a known manner.

In the embodiment illustrated here the printer 1 has a (single) door 9 closing the passage 10 guiding the document. It is possible, in other embodiments that are not illustrated, to provide a printer having a door arrangement comprising two or more doors arranged for closing the passage through which the document exits, for example two or more doors arranged alongside one another. Such doors could be movable independently of one another and/or be hinged around the same hinge axis.

In use, the printer 1 prints a document (in particular it will also separate the document from the strip by means of the blade 8 or other appropriate cutting arrangement) and thus moves the document to the outlet zone. As the document advances it will proceed through the passage 10 meeting the door 9 (normally in the closed position) and continuing along its journey to the outlet opening 7 it will open the door 9, pushing the door 9 forwards (with an opening rotation R). The document, also moved forwards by the supply arrangement of the printer (in particular by the pair of rollers 5), will thus come to protrude beyond the outlet opening 7, where it can be removed by the user. When the document is removed from the outlet zone 2 (for example by the user or automatically by the printer if the document is not removed by the user after a certain time), the door 9 can return to the closed position. The return to the closed position may occur spontaneously through the effect of the weight of the door 9.

The door 9, arranged in a normal closed position to obstruct the exit passage 10 of the document, prevents the undesired entry of objects from the exterior (in particular from the outlet zone 2) to the inside of the printer through the passage 10. The door 9 can protect the inside of the printer both against the attempt to introduce objects through the outlet 6 and against the entry of dust, rain, humidity or other undesired elements that could cause wear or damage.

The invention claimed is:

1. A printer, comprising:

a printer head configured to print a document and configured to feed the document to an outlet through which the printed document is dispensed to be removed by a user;

at least one passage through which the document is passed before being dispensed through said outlet;

an occluding element arranged between said at least one passage and said outlet, said occluding element being rotatable around a hinge axis between a closed position, in which it closes said at least one passage, and an open position, in which it enables the document to exit through said at least one passage, said occluding element being rotatable around said hinge axis in an opening direction to said open position by a thrust exerted by the document exiting through said at least one passage, before being dispensed through said outlet; and an abutting arrangement that stops rotation of said occluding element around said hinge axis in a closing direction opposite said opening direction, said abutting arrangement stopping rotation of said occluding element at said closed position;

wherein said occluding element abuts against said abutting arrangement so as to close said at least one passage and protect the inside of the printer against the attempt to introduce objects through said outlet preventing undesired intrusion of objects inside the printer through said at least one passage, said intrusion being fraudulent or an act of vandalism or accidental because of an inattentive user who inserts a banknote, a card or a form into a wrong opening.

2. The printer according to claim 1, wherein said abutting arrangement has at least one abutting surface arranged transversely to an advancing direction of the document through said at least one passage.

3. The printer according to claim 1, wherein said occluding element has at least one beating surface that abuts against an abutting surface of said abutting arrangement in a beating direction that is substantially perpendicular to said abutting surface so that substantially no slip occurs between said surfaces.

4. The printer according to claim 1, wherein in said closed position said occluding element has at least one obstructing portion that obstructs said at least one passage and at least one beating portion that interacts with said abutting arrangement and that protrudes beyond an edge of said at least one passage in a direction that is transverse to the advancing direction of the document through said at least one passage.

5. The printer according to claim 1, wherein said abutting arrangement has at least one abutting surface arranged at a step, said step being arranged downstream of said at least one passage obstructed by said occluding element, said abutting surface being arranged at a rise of said step.

6. The printer according to claim 1, comprising a separating arrangement configured to separate the document from the rest of a strip of material on which the document is printed.

7. The printer according to claim 1, wherein said shutting occluding element is rotatable around the hinge axis and has at least one free end that is far from said hinge axis.

8. The printer according to claim 7, wherein said at least one free end is arranged near an advancement path of the document exiting from said at least one passage.

9. The printer according to claim 7, wherein said occluding element is openable around said hinge axis with an opening rotation wherein said at least one free end lifts up and is closable with a closure rotation wherein said at least one free end lowers, said abutting arrangement achieving a stroke end of said closure rotation.

10. The printer according to claim 7, wherein said at least one free end comprises one or more protrusions each arranged for abutting against said abutting arrangement.

11. The printer according to claim 7, comprising a guiding and protecting lower wall that inferiorly bounds an advancement path of the document exiting through said at least one passage, said at least one free end being arranged above said lower wall, said at least one free end having a lower margin that, in said closed position, at least partially borders without slipping the below lower wall.

12. The printer according to claim 11, comprising a guiding and protecting upper wall that superiorly bounds said advancement path of the document and is at least partially arranged above said lower wall, said upper and lower walls extending beyond said occluding element with reference to an outlet direction of the document.

13. The printer according to claim 1, wherein said occluding element is shaped and arranged in such a manner as to return to said normal closed position solely through the effect of its weight.

14. The printer according to claim 1, wherein said at least one passage has a narrow and elongated shape and wherein said occluding element comprises a narrow and elongated shaped occluding element.

15. The printer according to claim 1, wherein said hinge axis is located behind said occluding element with reference to the advancing direction of the document through said at least one passage.

16. The printer according to claim 15, wherein said occluding element has a balance cantilever that protrudes forward from an upper portion of said occluding element.

17. The printer according to claim 1, wherein said occluding element has a plate shape that is arranged vertically in the normal closed position and in a tilted position in the open position.

18. The printer according to claim 1, wherein said at least one passage is defined by a guide portion arranged for guiding the advancement of the document; in particular said guide portion being in the form of an annular flange or protruding lip with a section converging forwards.

19. A printer, comprising, a printer head configured to print a document and configured to feed the document to an outlet zone;

an outlet arranged in said outlet zone, the printed document being dispensed outside through said outlet to be removed by a user;

at least one passage that is arranged in said outlet zone and through which the document is passed before being dispensed outside through said outlet;

a shutting arrangement arranged between said at least one passage and said outlet, said shutting arrangement being movable between a closed position, in which it closes said at least one passage, and an open position, in which it enables the document to exit through said at least one passage, said shutting arrangement movable to said open position by a thrust exerted by the document passing through said at least one passage, said shutting arrangement being a unidirectional shutting arrangement configured to enable the document to exit through said at least one passage in an outlet direction from an inside of the printer to said outlet zone, and to prevent entry of objects in an opposite direction from said outlet zone to the inside of the printer through said at least one passage, said shutting arrangement comprising an occluding element that is hinged around a hinge axis that is located behind said occluding element with reference to the advancing direction of the document through said at least one passage; and an abutting arrangement against which said shutting arrangement abuts closing said at least one passage at or near said closed position.

20. The printer according to claim 19, wherein said occluding element has a balance cantilever that protrudes forward from an upper portion of said occluding element.

* * * * *